US005082464A

United States Patent [19]

Clink

[11] Patent Number: 5,082,464

[45] Date of Patent: Jan. 21, 1992

[54] DIVER TOW VESSEL APPARATUS

[76] Inventor: Mason L. Clink, P.O. Box 746, Susanville, Calif. 96130

[21] Appl. No.: 668,097

[22] Filed: Mar. 12, 1991

[51] Int. Cl.[5] ..... B63C 11/46

[52] U.S. Cl. ..... 440/6; 114/56; 114/315; 114/357; 114/364

[58] Field of Search ..... 440/6; 114/56, 244, 114/245, 254, 255, 315, 351, 355, 357, 364; 405/186, 187

[56] References Cited

U.S. PATENT DOCUMENTS

| | | | |
|---|---|---|---|
| 1,579,529 | 4/1926 | Haschke | 440/6 |
| 2,972,326 | 2/1961 | Simpson | 114/253 |
| 3,732,587 | 5/1973 | Fletcher | 114/357 |
| 3,791,327 | 2/1974 | Deveney | 114/315 |
| 4,002,131 | 1/1977 | Mangrum | 114/56 |
| 4,348,976 | 9/1982 | Gilbert | 114/315 |
| 4,602,589 | 7/1986 | Quinata | 114/315 |
| 4,645,465 | 2/1987 | Courtney | 405/186 |
| 4,739,720 | 4/1988 | Jarschke | 114/347 |
| 4,919,631 | 4/1990 | Stafford | 405/186 |

FOREIGN PATENT DOCUMENTS

| | | | |
|---|---|---|---|
| 948041 | 5/1974 | Canada | 114/315 |
| 2323015 | 11/1974 | Fed. Rep. of Germany | 405/186 |

*Primary Examiner*—Sherman Basinger
*Assistant Examiner*—Thomas J. Braham
*Attorney, Agent, or Firm*—Leon Gilden

[57] ABSTRACT

An apparatus wherein a buoyant float body includes a top and bottom plate mounted to the relative top and bottom walls of the float body, wherein the top plate includes a battery support positioned adjacent a mounting bracket and an associated electric drive motor, and further including a support arrangement for mounting air tanks and the like for use in a diving procedure. Optionally, bag members are mounted to side walls of the float body for storage and subsequent access of components therewithin.

7 Claims, 4 Drawing Sheets 17
15
T
R
18
25
24
12
14
11
21
20
13
26
23
27

DIVER TOW VESSEL APPARATUS

BACKGROUND OF THE INVENTION

1. Field of the Invention

The field of invention relates to snorkeling and diving apparatus, and more particularly pertains to a new and improved diver tow vessel apparatus wherein the same floatingly mounts in operative association accessories for use in diving and snorkeling procedures.

2. Description of the Prior Art

Various devices have been utilized in the prior art to assist a diver and the like in diving procedures to permit convenient storage and transport of such organizations floatingly across a body of water. Diving apparatus in such organizations require diving tanks to be transported, wherein diving is normally effected in groups of at least two for safety purposes, wherein movement transport of accessories utilized in a dive is required. Prior art for use in such organizations may be found in U.S. Pat. No. 4,815,761 to Henderson, et al. wherein a framework is arranged with rollers at a lower end and a buoyancy tank to enhance flotation of the organization.

U.S. Pat. No. 4,599,072 to Pollini, et al. sets forth an aquatic apparatus utilizing two hollow shoes supporting a user under conditions of static floatage.

U.S. Pat. No. 3,115,860 to Payne provides a pontoon organization for mounting a skiff and the like, wherein the pontoons are formed of a buoyant material.

U.S. Pat. No. 3,561,025 to Teach sets forth the use of a water sled, wherein a buoyant plate mounts a seat structure thereon.

As such, it may be appreciated that there continues to be a need for a new and improved diver tow vessel apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of diver apparatus now present in the prior art, the present invention provides a diver tow vessel apparatus wherein the same is arranged for buoyantly mounting and supporting equipment for use in snorkeling and diving procedures. As such, the general purpose of the present invention, which will be described subsequently in greater detail, is to provide a new and improved driver tow vessel apparatus which has all the advantages of the prior art diving apparatus and none of the disadvantages.

To attain this, the present invention provides an apparatus wherein a buoyant float body includes a top and bottom plate mounted to the relative top and bottom walls of the float body, wherein the top plate includes a battery support positioned adjacent a mounting bracket and an associated electric drive motor, and further including a support arrangement for mounting air tanks and the like for use in a diving procedure. Optionally, bag members are mounted to side walls of the float body for storage and subsequent access of components therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved diver tow vessel apparatus which has all the advantages of the prior art diving apparatus and none of the disadvantages.

It is another object of the present invention to provide a new and improved diver tow vessel apparatus which may be easily and efficiently manufactured and marketed.

It is a further object of the present invention to provide a new and improved diver tow apparatus which is of a durable and reliable construction.

An even further object of the present invention is to provide a new and improved diver tow apparatus which is susceptible of a low cost of manufacture with regard to both materials and labor, and which accordingly is then susceptible of low prices of sale to the consuming public, thereby making such diver tow apparatus economically available to the buying public.

Still yet another object of the present invention is to provide a new and improved diver tow vessel apparatus which provides in the apparatuses and methods of the prior art some of the advantages thereof, while simultaneously overcoming some of the disadvantages normally associated therewith.

Still another object of the present invention is to provide a new and improved diver tow vessel apparatus wherein the same sets forth a unitary float body mounting support structure for motivation and support of various components in a diving procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
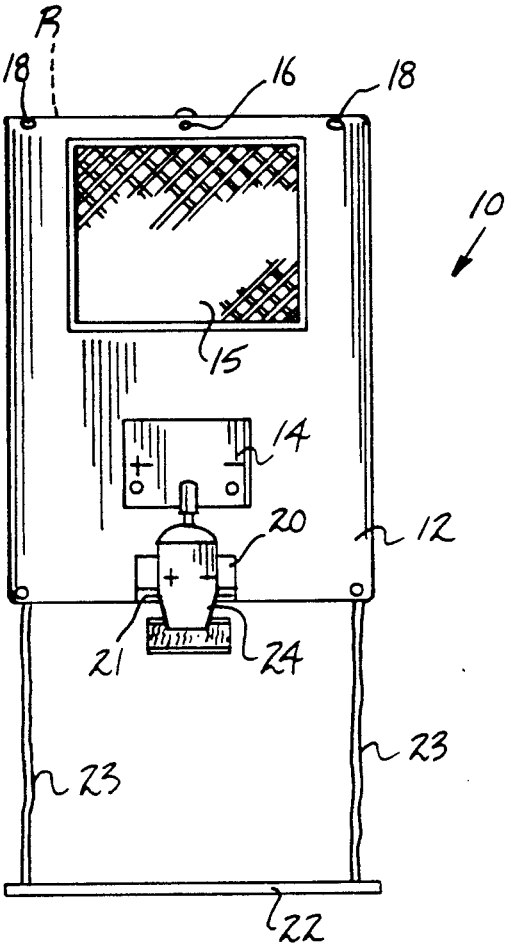
FIG. 1 is an orthographic top view of the instant invention.
Figure 2:
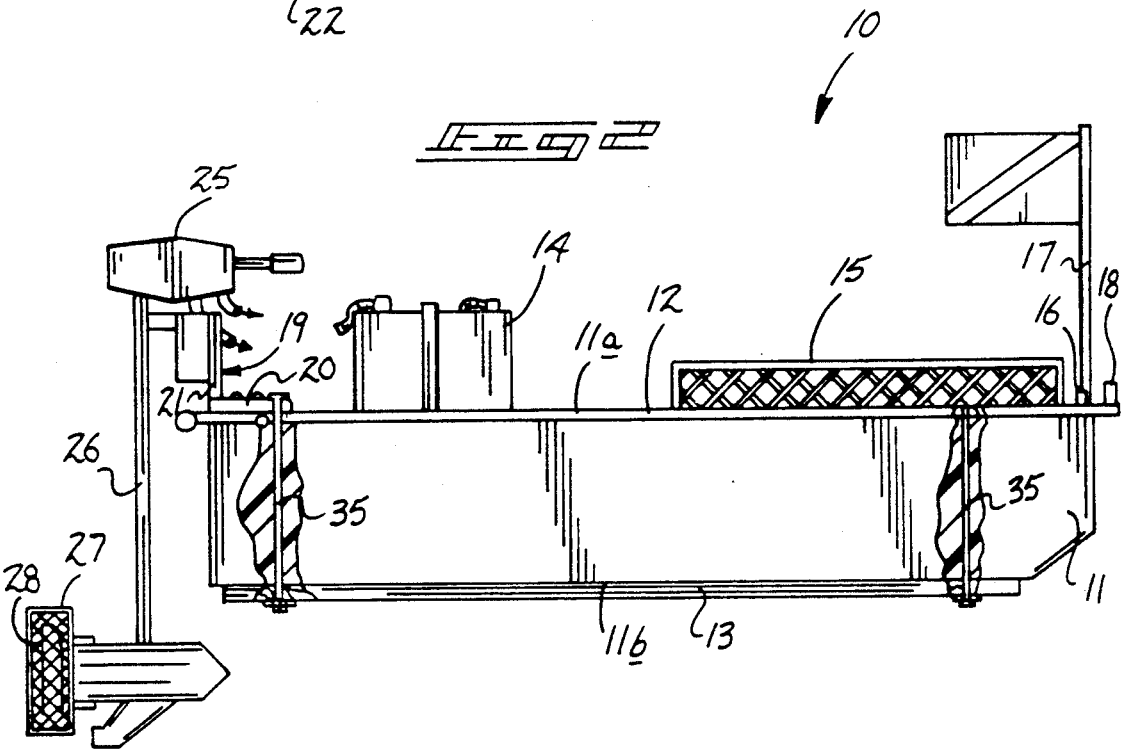
FIG. 2 is an orthographic side view of the instant invention.
Figure 3:
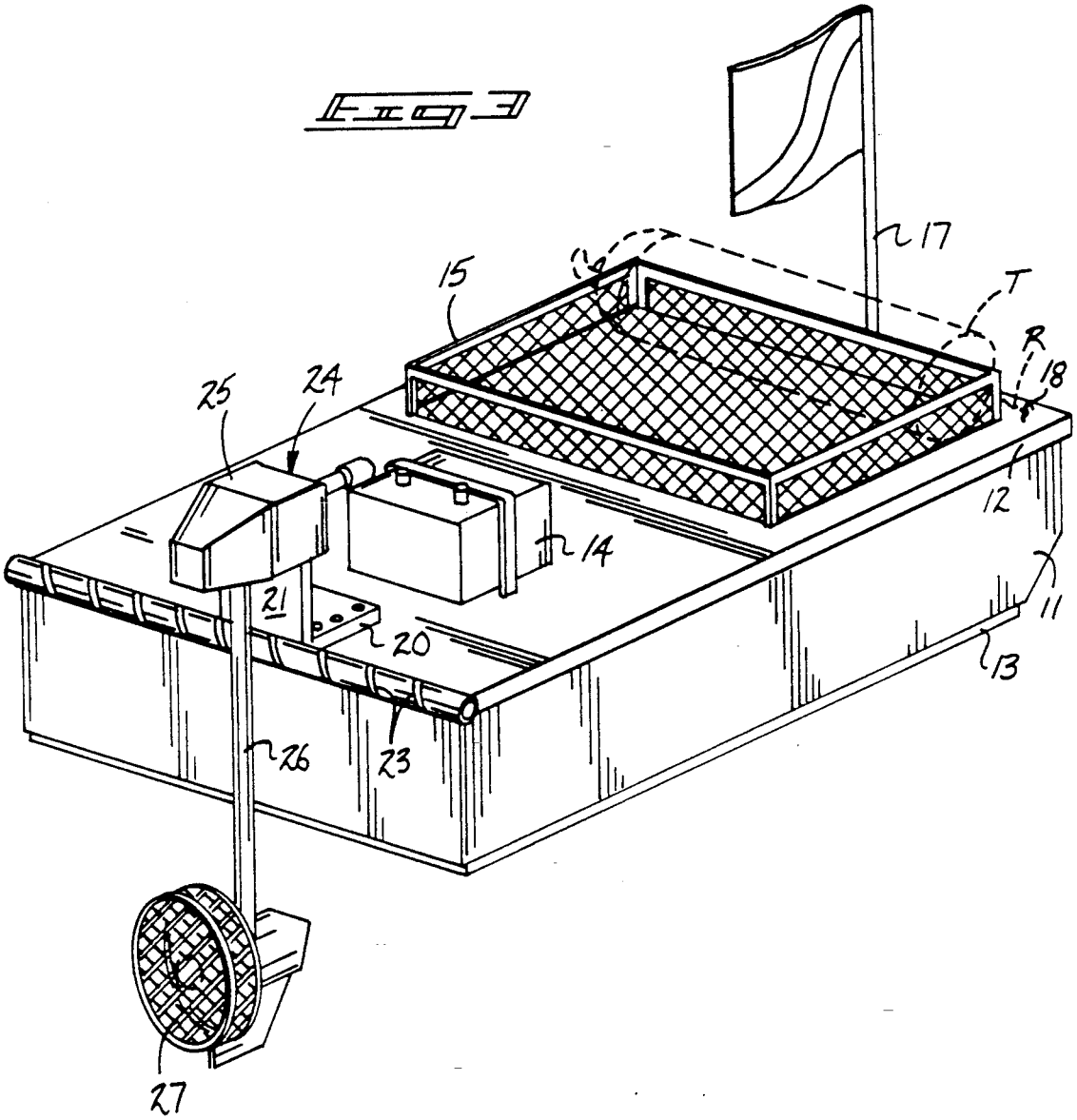
FIG. 3 is an isometric illustration of the instant invention.

With reference now to the drawings, and in particular to FIGS. 1 to 6 thereof, a new and improved diver tow vessel apparatus embodying the principles and concepts of the present invention and generally designated by the reference numeral 10 will be described.

More specifically, the diver tow vessel apparatus 10 of the instant invention essentially comprises a buoyant float body 11 defined by a planar top wall 11*a* spaced from and parallel to a planar bottom wall 11*b*. Planar side walls are spaced between a forward end wall spaced from and parallel to a rear end wall. The top plate 12 mounts a battery 14 fixedly thereon utilizing a battery strap, wherein a support bracket 15 is positioned forwardly of the battery and medially of the top plate 12 spaced from the forward edge of the top plate. A flag socket 16 is orthogonally mounted between the support basket container 15 and the forward edge of the top plate, and further including a plurality of spaced hooks 18 mounted adjacent the forward edge of the top plate forwardly of the socket 16, wherein the spaced hooks 18 mount a rope "R" therebetween. The flag socket 16 mounts a flag shaft 17 therewithin utilizing a diver's flag for signalling a diving procedure about the apparatus 10. An "L" shaped mounting plate 19 is positioned medially and adjacent the rear edge of the top plate 12, wherein the "L" shaped mounting plate 19 includes a horizontal leg 20 fixedly mounted to the top plate 12 and a vertical mounting leg 21 directed orthogonally and upwardly relative to the mounting plate, with a vertical mounting leg 21 mounting an electric outboard motor assembly 24 thereon. The electric motor assembly 24 includes a housing 25 mounting a shaft 26 extending orthogonally relative to the rear terminal edge of the top plate 12 and below the bottom plate 13, wherein a mesh cage 27 orthogonally oriented relative to the lower terminal end of the shaft 26 mounts a propeller 28 therewithin for effecting propulsion of the organization. A tow bar 22 is mounted to the rear terminal edge of the top plate 12 by spaced rope members 23. The tow bar 22 is unfurled to permit a diver or divers to be towed by the apparatus during transport to a diving site.

Figure 4:
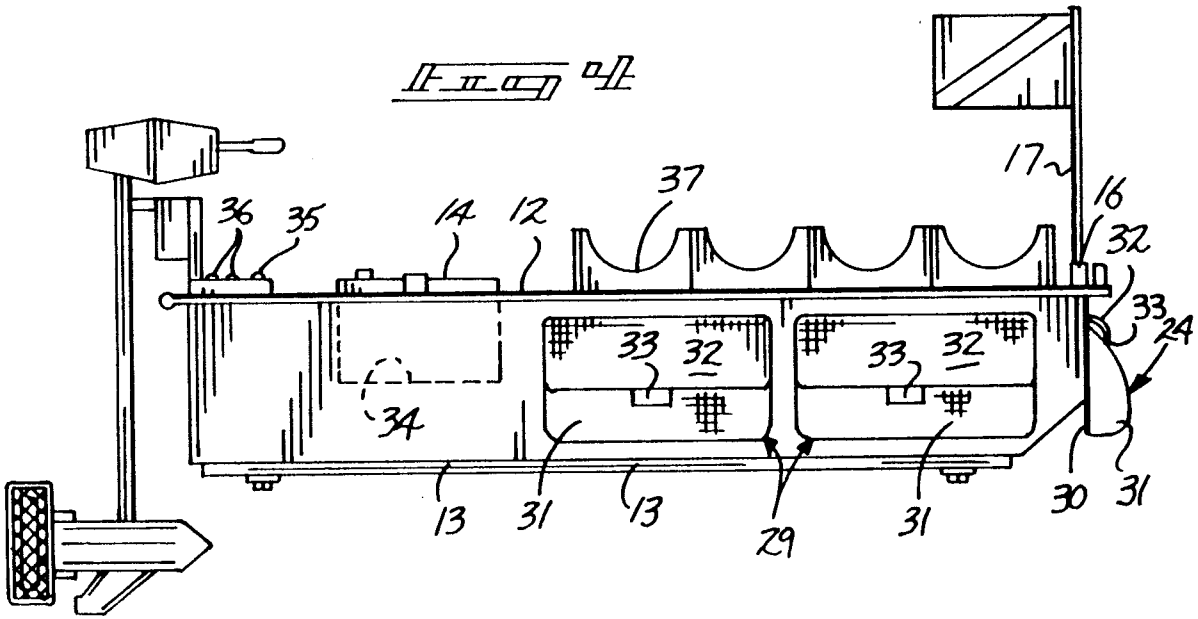
FIG. 4 is an orthographic side view of a modification of the instant invention.
Figure 5:
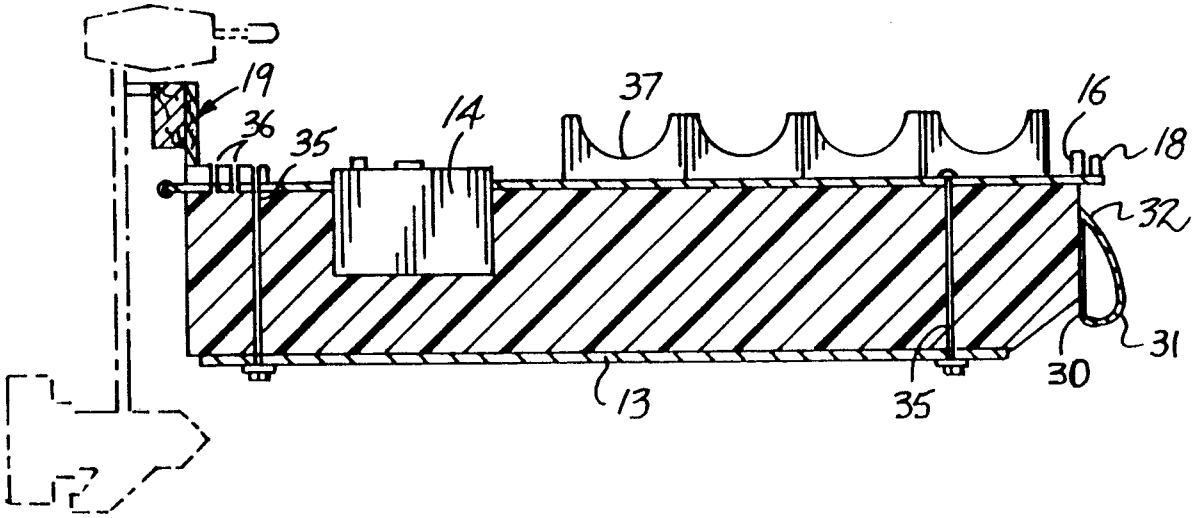
FIG. 5 is an orthographic side view, taken in cross-section, of the modification of the invention as set forth in FIG. 4.
Figure 6:
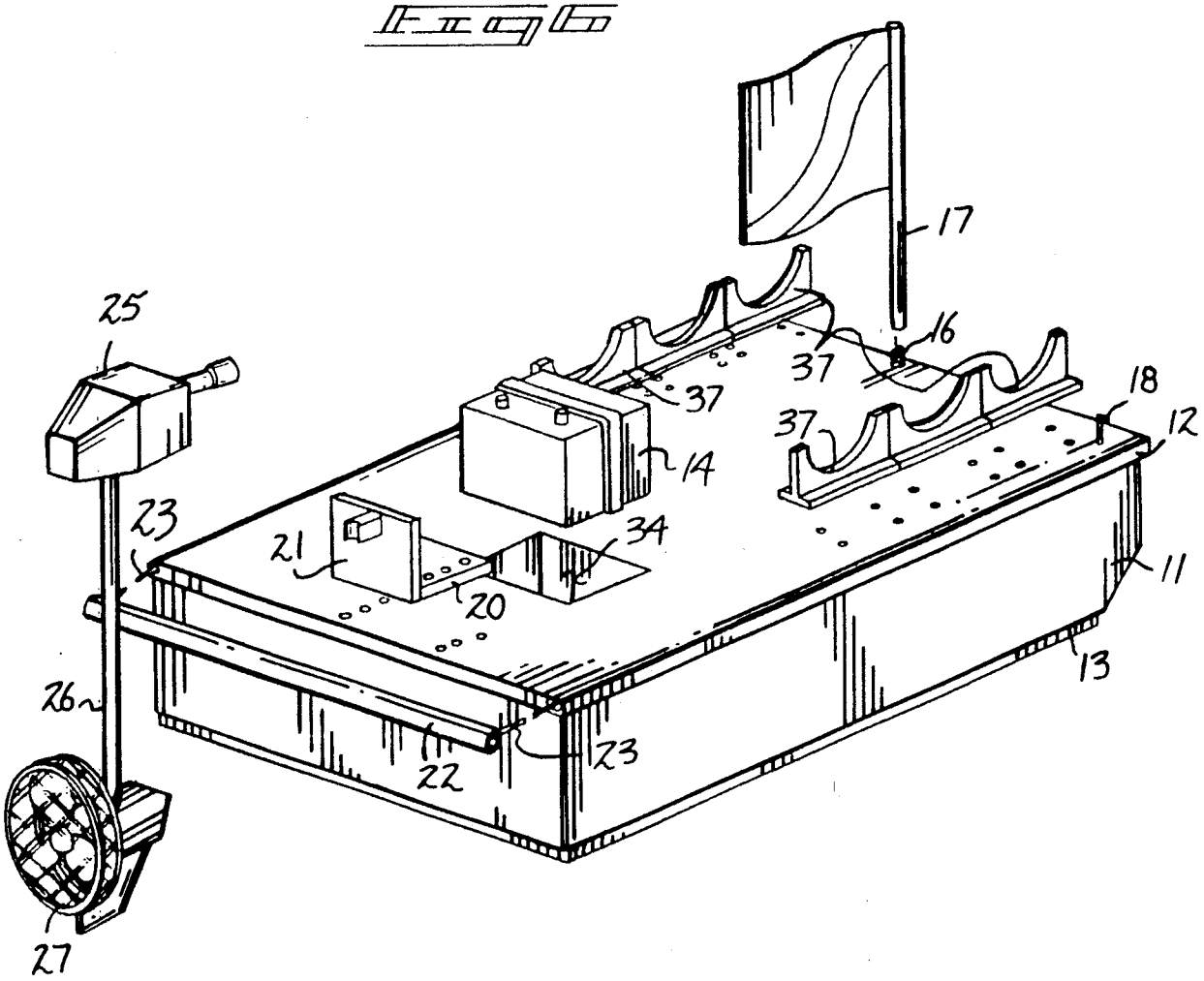
FIG. 6 is an isometric illustration of the modification of the instant invention.

Reference to FIGS. 4–6 illustrate a modified organization, wherein a plurality of bag members 29 are mounted to the side walls and forward wall of the buoyant float body 11. The bag members each include a rigid bag plate 30 that is fixedly mounted to the side and forward wall of the float body at equally spaced intervals, wherein the rigid bag plate 30 mounts a flexible bag 31 thereon. The flexible bag 31 includes a bag flap 32 utilizing hook and loop faster connectors 33 to secure the bag flap in a selective overlying relationship relative to the flexible bag 31.

A battery cavity 34 positioned medially of the top plate 12 is directed into the float body 11 to receive, in a complementary manner, the associated battery 14 therewithin. Further, it should be noted that a plurality of through-extending fasteners 35 are directed from the horizontal mounting leg 20, through the top plate 12, and into and securing the bottom plate 13 in an orthogonal orientation relative to the horizontal mounting leg, the top plate 12, and the bottom plate 13. A further plurality of through-extending fasteners 35 are directed through the top and bottom plates 12 and 13 adjacent the forward terminal edge of the top plate and bottom plate, as illustrated in FIG. 5 for example. Fasteners 36 are also used to enhance securement of the horizontal mounting leg 20 to the top plate 12. Optionally, a plurality of spaced pairs of parallel coaxially aligned semi-cylindrical supports 37 are mounted medially and forwardly of the battery cavity 34 between the flag socket 16 and the battery cavity, wherein each pair of such semi-cylindrical supports 37 mounts an air tank "T" therebetween for storing in a non-rotating manner each of the air tanks relative to the top surface of the top plate 12.

It is understood that the organization is arranged for the transport and temporary storage of various diving apparatus to enhance ease of transport and organization of diving expeditions in various bodies of water, and may be easily transported about a mother ship or launched from a shoreline, as required.

As to the manner of usage and operation of the instant invention, the same should be apparent from the above disclosure, and accordingly no further discussion relative to the manner of usage and operation of the instant invention shall be required.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A diver tow vessel apparatus comprising, in combination, an elongate float body, the float body formed of a buoyant material, including spaced side walls, a forward wall spaced from and parallel a rear wall, and a planar top wall spaced from and parallel a bottom wall, and a top plate mounted contiguously to and extending beyond the forward wall and rear wall, and a bottom plate mounted to the bottom wall, and a battery mounted medially of the top plate, and an "L" shaped mounting plate mounted to a rear terminal edge of the top plate, and an electric trolling motor mounted to the "L" shaped mounting plate in electrical communication with the battery, and a plurality of "L" shaped mounting hooks positioned adjacent a forward edge of the top plate and including a rope member mounted therebetween, and a flag socket mounted adjacent to and medially of the forward edge of the top plate, wherein the flag socket includes a flag shaft mounted within the flag socket, wherein the flag shaft includes a diver's flag positioned thereon, and support means positioned between the battery and the flag socket for supporting a plurality of air tanks thereon.

2. An apparatus as set forth in claim 1 wherein the rear edge of the top plate includes a plurality of rope members mounted thereto, and the rope members including a tow bar mounted to the rope members, and the "L" shaped mounting plate mounted medially of the rear edge of the top plate and the "L" shaped mounting plate including a horizontal mounting leg mounted to the top plate and a vertical mounting leg mounting the electric trolling motor removably thereto, and the electric trolling motor including an electric housing, wherein the electric housing includes a shaft extending orthogonally relative to the housing, wherein a mesh cage is mounted adjacent a lower terminal edge of the shaft, including a propeller rotatably mounted therewithin.

3. An apparatus as set forth in claim 2 including a plurality of through-extending fasteners directed through the top plate and the bottom plate and directed through the float body to secure the top plate, the bottom plate, and the float body together.

4. An apparatus as set forth in claim 3 further including a parallelepiped battery cavity, wherein the battery cavity complementarily receives a battery therewithin, wherein the battery cavity is directed into the float body.

5. An apparatus as set forth in claim 4 wherein the support means includes plural pairs of spaced, parallel, coaxially aligned semi-cylindrical supports, wherein each pair of semi-cylindrical supports is arranged for mounting an air tank thereon.

6. An apparatus as set forth in claim 5 wherein the forward wall and the side walls each include a plurality of equally spaced bag members mounted thereon, each of the bag members includes a rigid bag plate fixedly mounted to respective forward and side walls, wherein the rigid bag plate includes a flexible bag mounted thereon, the flexible bag includes a flexible bag flap secured to the bag plate removably mounted overlying the flexible bag utilizing hook and loop fasteners connections between the flexible bag and the flexible bag flap.

7. An apparatus as set forth in claim 6 wherein the "L" shaped mounting plate, the battery cavity, and the semi-cylindrical supports are positioned medially of the top plate and aligned relative to one another.

* * * * *